US006971731B2

(12) United States Patent
Brenner et al.

(10) Patent No.: US 6,971,731 B2
(45) Date of Patent: Dec. 6, 2005

(54) PERFORMING POWER REDUCTION ACTION WHEN AVERAGE POWER UTILIZATION FOR INKJET PRINTING A SWATH EXCEEDS A THRESHOLD

(75) Inventors: James M. Brenner, Vancouver, WA (US); Jason Quintana, Brush Prairie, WA (US); Ronald A. Juve, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 58 days.

(21) Appl. No.: 10/463,290

(22) Filed: Jun. 17, 2003

(65) Prior Publication Data

US 2004/0257392 A1 Dec. 23, 2004

(51) Int. Cl.[7] ..... B41J 29/38; B41J 29/393
(52) U.S. Cl. ..... 347/14; 347/19
(58) Field of Search ..... 347/14, 19, 194, 347/196, 37

(56) References Cited

U.S. PATENT DOCUMENTS 4,553,867 A * 11/1985 Nakai
4,566,014 A * 1/1986 Paranjpe et al.
5,349,905 A * 9/1994 Taylor et al.
5,389,956 A 2/1995 Hadimioglu et al.
6,072,585 A * 6/2000 Dutton et al.
6,114,837 A * 9/2000 Nakanishi ..... 320/136
6,174,037 B1 * 1/2001 Donahue et al. ..... 347/9
6,209,984 B1 * 4/2001 Kim
6,234,695 B1 * 5/2001 Freedman et al.
6,302,520 B1 * 10/2001 Akiyama et al. ..... 347/43
6,497,468 B1 * 12/2002 Otsuka
6,648,441 B2 * 11/2003 Naoi ..... 347/13
6,695,425 B2 * 2/2004 Usui et al. ..... 347/14
2001/0022597 A1 * 9/2001 Yoshida ..... 347/14
2002/0051024 A1 5/2002 Naoi
2002/0135631 A1 * 9/2002 Sasaki et al. ..... 347/19

FOREIGN PATENT DOCUMENTS

EP 1093923 A1 4/2001
GB 2365822 A * 2/2002 ..... B41J 02/505
JP 2001-270156 A 10/2001

OTHER PUBLICATIONS

Search Report for United Kingdom Patent Application No. GB0413009.2 (Sep. 27, 2004).

* cited by examiner

*Primary Examiner*—Thinh Nguyen

(57) ABSTRACT

A method of an embodiment of the invention is disclosed that determines the average power utilization for inkjet printing a print swath. In response to determining that the average power utilization exceeds a threshold, an average power reduction action is performed.

30 Claims, 6 Drawing Sheets

PERFORMING POWER REDUCTION ACTION WHEN AVERAGE POWER UTILIZATION FOR INKJET PRINTING A SWATH EXCEEDS A THRESHOLD

BACKGROUND OF THE INVENTION

Inkjet printers have become popular with both home and business users. They have especially proven to be a low-cost way to print color hardcopies of images such as photographs. With the increasing sophistication of inkjet printers, many users, especially home users, concentrate on cost as a significant factor on which to base decisions as to which inkjet printers to purchase.

One factor that can affect the cost of an inkjet printer is its power supply. An inkjet printer utilizes power, for instance, when advancing media, such as paper, through the printer, when moving the inkjet printhead back and forth over a swath of media, and especially when ejecting ink onto the swath of media by the printhead. The amount of power utilized when ejecting ink onto a media swath is variable, and depends on, among other things, the number of ink-jet nozzles of the inkjet printhead that are to eject ink at any given time.

When all of the inkjet nozzles are firing at the same time for an extended length of time, such as over a complete swath of media, the inkjet printer is likely to utilize a maximum amount of power. Therefore, an inkjet printer's power supply may be designed to be able to provide this amount of power, or a large percentage thereof, when needed. However, the probability that all of the ink-jet nozzles will eject ink at the same time over a complete swath of media is highly unlikely, and represents a relatively rare inkjet-printing situation. This means that the power supply is likely to be larger, and thus more expensive, than is needed in most inkjet-printing situations.

SUMMARY OF THE INVENTION

A method of an embodiment of the invention determines the average power utilization for inkjet printing a print swath. In response to determining that the average power utilization exceeds a threshold, an average power reduction action is performed.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
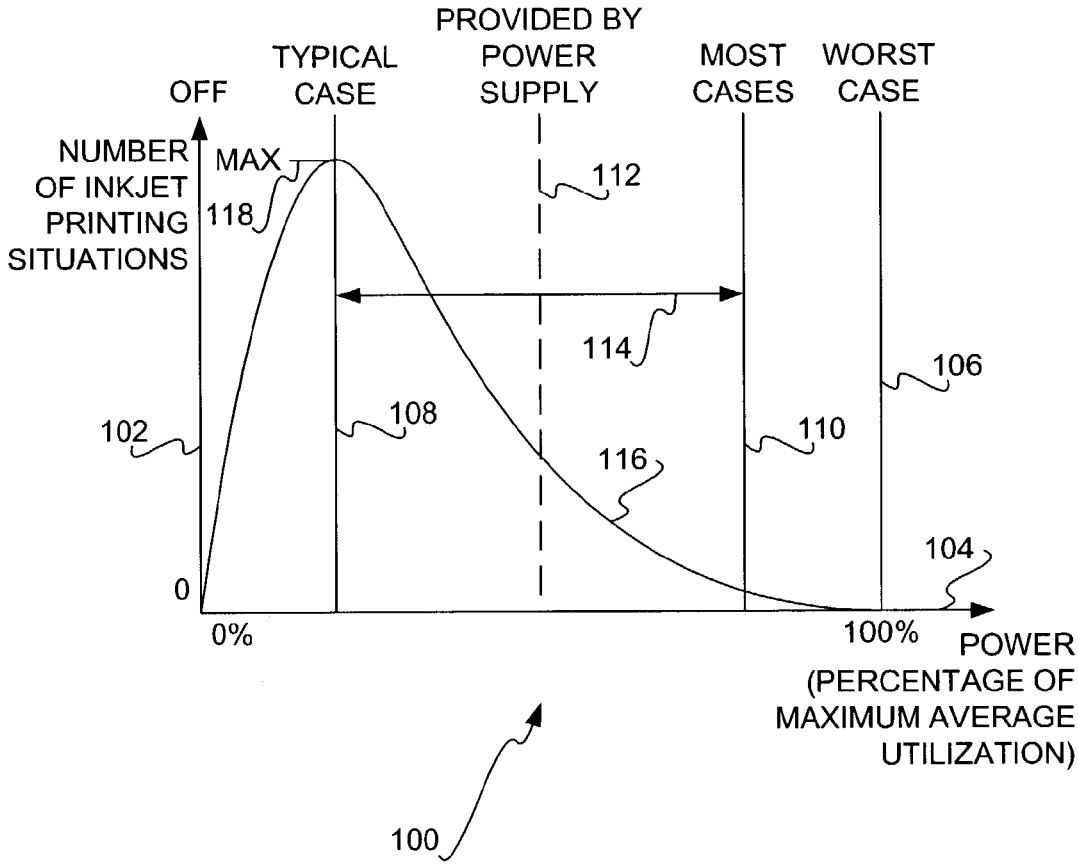
FIG. 1 is a graph of an example distribution of the number of inkjet-printing situations by the percentage of their maximum average power utilization, according to an embodiment of the invention.

Reducing Average Power Utilization or Consumption when Inkjet Printing a Swath FIG. 1 shows a graph 100 of an example distribution of a number of inkjet-printing situations by the percentage of their maximum average power utilization, according to an embodiment of the invention. An inkjet-printing situation can be defined in one embodiment of the invention as the ejection of ink over a complete swath of media by an inkjet-printing mechanism, such as an inkjet printhead. That is, an inkjet-printing situation may be the inkjet printing over a complete pass, or sweep, of the media, from a left edge of the media to a right edge of the media.

The y-axis 102 of the graph 100 indicates the number of inkjet-printing situations as a function of the percentage of maximum average power utilization by them, as indicated on the x-axis 104. The average power utilization of an inkjet-printing situation is the average amount of power utilized by the inkjet-printing mechanism when ejecting ink in accordance with the situation. For instance, the average power utilization of an inkjet-printing situation may be the average amount of power utilized by the inkjet-printing mechanism during the time it takes for the mechanism to eject ink over a complete swath of media in accordance with the situation.

The curve 116 represents the distribution of the number of inkjet-printing situations by the percentage of their maximum average power utilization. All of the inkjet-printing situations fall to the left of the worst-case scenario, or situation, indicated by the vertical line 106. That is, by definition, all of the inkjet-printing situations use at most 100% of the maximum average power utilization. The worst-case situation, which may also be referred to as the printing of a swath of media in a worst-case print job, is thus the maximum amount of power that a given inkjet-printing mechanism can utilize when printing a swath of media. For instance, this may correspond to the situation where all of the nozzles on the mechanism are firing for the entire length of the media swath.

However, most of the inkjet-printing situations fall to the left of the most-cases scenario, or situation, indicated by the vertical line 110. That is, in most cases, an inkjet-printing situation is likely to utilize at most a percentage of the maximum average power indicated by the vertical line 110. The most-cases situation means that for inkjet printing a given media swath, the amount of power utilized will be no greater than the level of power indicated by the vertical line 110. The level of power for the most-cases situation can be arbitrarily determined, or otherwise estimated, such as by statistically analyzing a number of print jobs and the power that they utilize on a per-swath basis. For example, the level of power indicated by the vertical line 110 may be arbitrarily set to 80% of the maximum power utilization, or another percentage of the maximum power utilization. The most-cases situation may also be referred to as the most-print jobs situation. That is, the average power utilized in most cases is the average power utilized in printing a swath of media for most print jobs.

Furthermore, the typical inkjet-printing scenario, or situation, is indicated by the vertical line 108, which intersects with the curve 116 at the maximum of the curve 116, indicated by the horizontal line 118. That is, in the typical inkjet-printing situation utilizes a percentage of the maximum average power indicated by the vertical line 108. The typical-case situation, which is also referred to as printing a swath of media in a typical print job, means that for inkjet printing a typical swath of media, the amount of power will be no greater than the level of power indicated by the vertical line 108. Like the most-cases situation, the level of power for the typical-case situation can be arbitrarily determined, or otherwise estimated, such as by statistically analyzing a number of print jobs and the power that they utilize on a per-swath basis. For example, the level of power indicated by the vertical line 108 may be arbitrarily set to 20% of the maximum power utilization, or another percentage of the maximum power utilization.

The maximum average power that is able to be provided to the inkjet-printing mechanism of an inkjet-printing device by a power supply of the device is indicated by the dotted vertical line 112. The dotted vertical line 112 is preferably located between the vertical line 108, representing the typical case average power utilization scenario, and the vertical line 110, representing the most-cases scenario. That is, the maximum average power that is able to be provided to the inkjet-printing mechanism for inkjet printing a media swath preferably is an amount of power that is greater than or equal to the percentage indicated by the vertical line 108, and is less than or equal to the percentage indicated by the vertical line 110, as indicated by the bi-directional arrow 114. This means that for at least some inkjet-printing situations, the inkjet-printing mechanism will utilize more power on average than the maximum average power that the power supply is able to provide.

Such situations are generally referred to as the average power utilization for inkjet printing a print swath as exceeding an inkjet-printing average power utilization threshold, where the threshold is defined in any of a number of ways. In one embodiment, the threshold may be defined as the maximum average power amount able to be provided by the power supply of the inkjet-printing device to the inkjet-printing mechanism of the device. In another embodiment, the threshold may be defined as a predetermined percentage of a maximum, worst-case inkjet-printing average power utilization, where the maximum, worst-case average utilization is indicated by the vertical line 106. In other embodiments, the threshold may be defined as a typical-case or a most-cases inkjet-printing average power utilization, such as that indicated by the vertical lines 108 and 110, respectively.

When the average power utilized for inkjet printing a print swath exceeds this threshold, an average power reduction action is performed to lower the average power utilized for inkjet printing the print swath. For instance, the power supply of the inkjet-printing device may be able to provide a maximum average amount of power P over a period of T. The inkjet-printing mechanism of the device may utilize an average amount of power p to eject ink onto a media swath over a period of t less than T. Therefore, an average power reduction action may be performed when p is greater than P so that the average amount of power provided by the power supply to the inkjet-printing mechanism over the period of T is no greater than P.

Figure 2A:
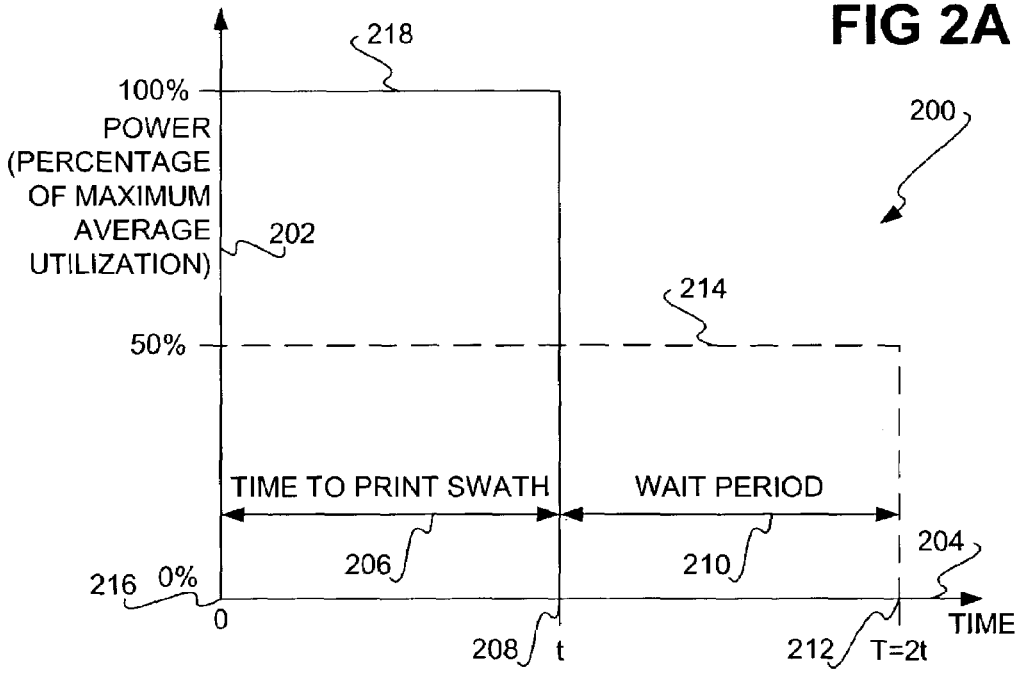
FIGS. 2A and 2B are graphs depicting how the average power utilization for inkjet printing a print swath can be reduced by waiting for a period of time after and before, respectively, printing the print swath, according to varying embodiments of the invention.
Figure 2B:
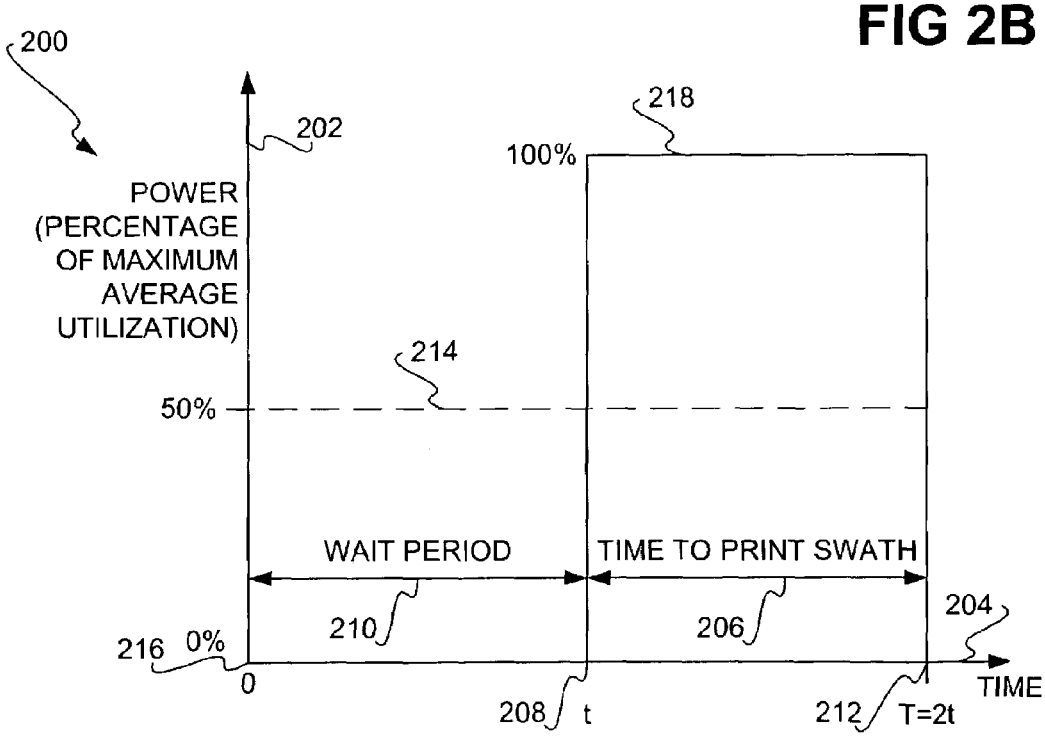

FIGS. 2A and 2B show a graph 200 that depict how a wait, or pause, period 210 may be introduced as one such average power reduction action to lower the average power utilized by the inkjet-printing mechanism, according to varying embodiments of the invention. In the graph 200, the x-axis 204 measures time, on which the time t is indicated by the reference number 208, and the time 2t is indicated by the reference number 212. For descriptive and illustrative convenience, the time period T is arbitrarily set equal to 2t. The y-axis 202 measures the average amount of power utilized, as a percentage of the maximum average power utilization.

In FIG. 2A, the time 206 it takes to print a swath of media is indicated as occurring between times 0 and t, as indicated by the reference numbers 216 and 208, and occurs before the wait period 210, which occurs between the times t and 2t, as indicated by the reference numbers 208 and 212. Conversely, in FIG. 2B, the time 206 it takes to print a swath of media is indicated as occurring between times t and 2t, and occurs after the wait period 210, which occurs between times 0 and t. That is, the difference between FIGS. 2A and 2B is that in the former the swath of media is inkjet printed before the wait period 210, whereas in the latter the swath is inkjet printed after the wait period 210.

Introducing the wait period 210 before or after the inkjet-printing mechanism has printed a complete swath of media lowers the average power utilized by the mechanism during the time period T. For example, during the time 206 when the inkjet-printing mechanism is ejecting ink over the print swath, the amount of power utilized or utilized by the mechanism may be, for sake of descriptive simplicity, 100% of the maximum average utilization, as indicated by the line 218. By comparison, during the wait period 210, the inkjet-printing mechanism is in a wait state, and may utilize, also for the sake of descriptive simplicity, no power on average. In this example, then, the average power utilized or consumed by the inkjet-printing mechanism during the time period T is 50% of the maximum average utilization, as indicated by the dotted line 214, as opposed to 100% of the maximum average utilization, as indicated by the line 218, during the time period from 0 to t in FIG. 2A or from t to 2t in FIG. 2B.

Figure 3A:
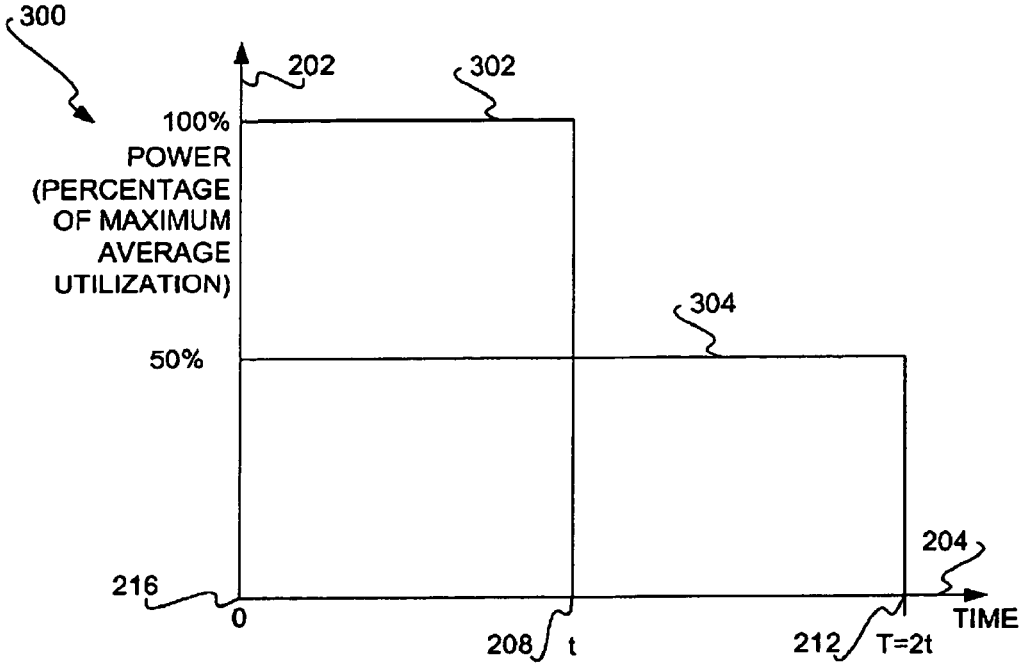
FIGS. 3A and 3B are a graph and a diagram, respectively, depicting how the average power utilization for inkjet printing a print swath can be reduced by dividing the print swath into two half-height swaths and printing the half-height swaths separately, according to an embodiment of the invention.
Figure 3B:
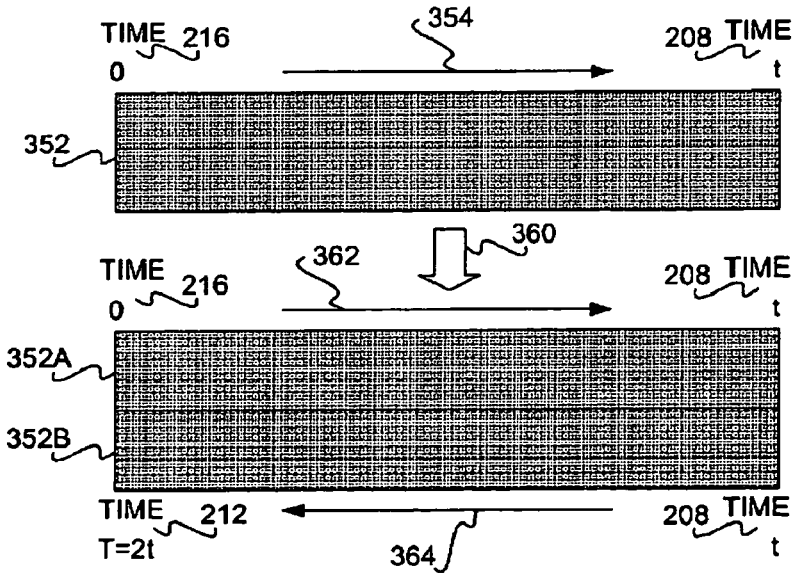

FIGS. 3A and 3B depict how a full-height print swath of media 352 may be divided into two half-height swaths 352A and 352B to be inkjet printed separately, as another average power reduction action to lower the average power utilized by the inkjet-printing mechanism, according to an embodiment of the invention. FIG. 3A specifically shows a graph 300 that shows a line 302 indicating the average amount of power utilized when printing the full-height swath 352, and a line 304 indicating the average amount of power utilized when printing the half-height swaths 352A and 352B. The y-axis 202 denotes average power as a percentage of maximum average power utilization, as a function of time as indicated on the x-axis 204.

FIG. 3B specifically shows diagrammatically how the full-height print swath of media 352 is divided into the half-height print swaths of media 352A and 352B. The division of the full-height swath 352 into two half-height swaths 352A and 352B is for illustrative and descriptive convenience. Other embodiments of the invention may divide the full-height swath of media 352 into any other number of partial-height swaths. For example, the full-height swath of media 352 may be divided into three one-third-height swaths of media, four one-fourth-height swaths of media, and so on.

To print the full-height print swath 352, the inkjet-printing mechanism may travel from left to right over the swath 352, as indicated by the arrow 354 in FIG. 3B, during the time period from the time 0, indicated by the reference number 216, to the time t, indicated by the reference number 208. While traveling from left to right over the swath 352, the inkjet-printing mechanism ejects ink onto the full height of the swath 352. In so doing, the inkjet-printing mechanism may utilize, as an example for the sake of descriptive clarity, 100% of the maximum power utilization, as indicated by the line 302 in FIG. 3A.

By comparison, upon dividing the full-height print swath 352 into the half-height print swaths 352A and 352B, as indicated by the large arrow 360, the inkjet-printing mechanism separately prints the half-height print swaths 352A and 352B. For instance, the inkjet-printing mechanism may travel from left to right and eject ink over the upper half-height swath 352A, as indicated by the arrow 362 in FIG. 3B, during the time period from the time 0 to the time t. The mechanism may then travel from right to left and eject ink over the lower half-height swath 352B, as indicated by the arrow 364 in FIG. 3B, during the time period from the time 0 to the time 2t, or T. When ejecting ink onto either half-height swath 352A or 352B, the inkjet-printing mechanism may utilize, as an example of the sake of descriptive clarity, 50% of the maximum power utilization, as indicated by the line 304 in FIG. 3A.

By decreasing the number of inkjet nozzles of the inkjet-printing mechanism that need to eject ink, or fire, at any given time, the amount of power utilized by the mechanism thus decreases. For instance, the inkjet-printing mechanism may utilize 50% of the maximum power utilization, as indicated by the line 304 in FIG. 3A, instead of 100% of the maximum power utilization, due to half as many nozzles ejecting ink at a given time. That is, dividing the full-height print swath 352 into two separately printed half-height print swaths 352A and 352B may increase the total print time from t to 2t, but may decrease the average power utilization while printing from 100% to 50%, reducing the average amount of power utilized by the inkjet-printing mechanism.

Methods

Figure 4:
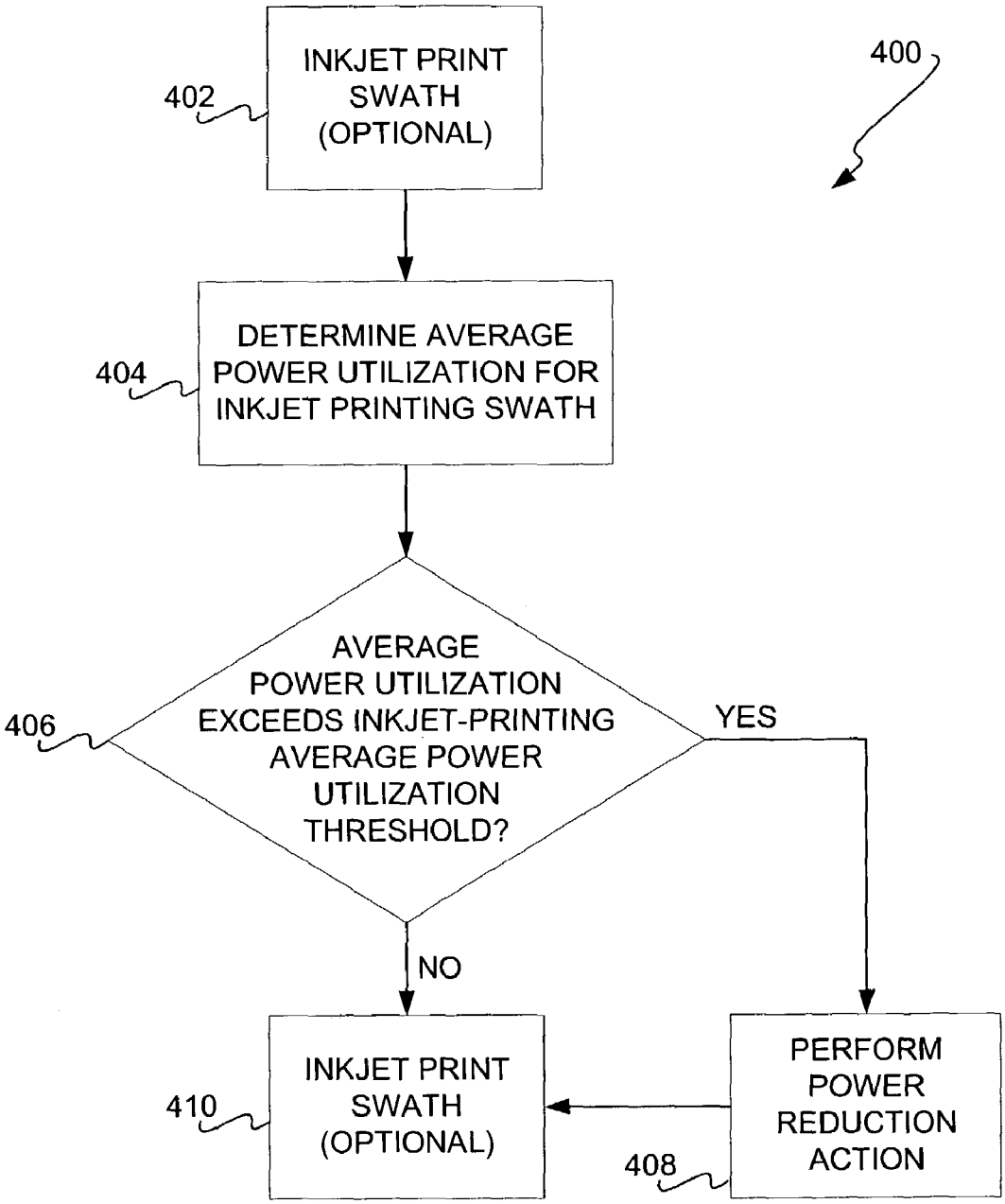
FIG. 4 is a flowchart of a method for reducing the average power utilized while inkjet printing a print swath of media, according to an embodiment of the invention.

FIG. 4 shows a method 400 for inkjet printing a print swath of media, including reducing the average power utilized during such inkjet printing when appropriate, according to an embodiment of the invention. Like other methods of embodiments of the invention, the method 400 may be implemented as a computer program stored on a computer-readable medium. The computer-readable medium may be a volatile or a non-volatile medium, a removable or a fixed medium, and a magnetic, optical, and/or semiconductor medium. The medium may be part of or include the firmware and/or the controller of an inkjet-printing device, such as an inkjet printer.

Optionally, the print swath of media is initially inkjet printed (402). The average power utilization for inkjet printing the print swath of media is determined (404). This may be, for instance, the average power utilized by an inkjet-printing mechanism, such as an inkjet printhead having a number of nozzles, or jets, of an inkjet-printing device when ejecting ink onto the swath. If it is determined that this average power utilization exceeds an inkjet-printing average power utilization threshold (406), then an average power reduction action is performed (408). The inkjet-printing average power utilization threshold may be any of a number of different thresholds, as particularly delineated in the previous section of the detailed description. Likewise, the average power reduction action that is performed may be any of a number of different actions, as also particularly delineated in the previous section of the detailed description.

Regardless of whether the average power utilization exceeds the inkjet-printing average power utilization threshold, the print swath of media is ink-jet printed (410), if it was not initially inkjet printed in 402 of the method 400 of FIG. 4. When the swath is inkjet printed in 410, it is inkjet printed in accordance with any power reduction action that may have been performed in 408. The print swath of media may thus be inkjet printed in 402 before the average power utilization for inkjet printing the swath is determined, where such determination is likely to be the actual, measured average power utilization. Alternatively, the print swath of media may be inkjet printed in 410 after the average power utilization for inkjet printing the swath is determined, where such determination is a predictive assessment of the average power utilization.

Figure 5:
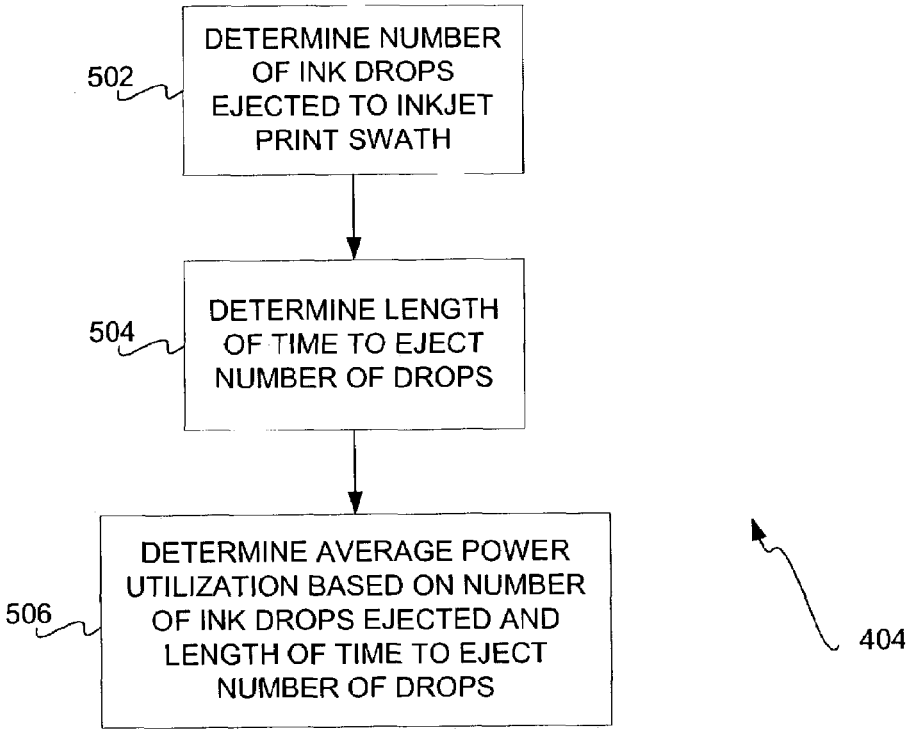
FIG. 5 is a flowchart of a method for determining the average utilization for inkjet printing a print swath of media, according to an embodiment of the invention.

FIG. 5 shows a method for determining the average power utilization for inkjet printing the swath of media in 404 of the method 400 of FIG. 4, according to an embodiment of the invention, in which the swath of media is preferably but not necessarily printed in 410 and not in 402. First, the number of ink drops to be ejected onto the print swath to inkjet print the swath of media is determined (502). Different print jobs typically have different numbers of drops of ink that are to be ejected for a given media swath, in accordance with the image that is to be output or formed onto the media as a result of ejecting ink onto the swaths of the media.

Next, the length of time it takes to eject the number of drops of ink over the swath of media is determined (504). This length of time is the time it takes for the inkjet-printing mechanism to travel completely over the swath of media, from one side of the media to the other side of the media. The length of time may be a fixed value that is stored in firmware of the inkjet-printing device, for instance, or derived based on the sweep speed and distance. The average power utilization is finally determined based on the number of ink drops ejected, and on the length of time to eject the ink drops over the print swath (506). For instance, each ink drop may correspond to a given amount of power utilized by the inkjet-printing mechanism, such that the total power utilized, divided by the length of time it takes to print all the ink drops, results in the mechanism's average amount of power utilization.

Figure 6A:
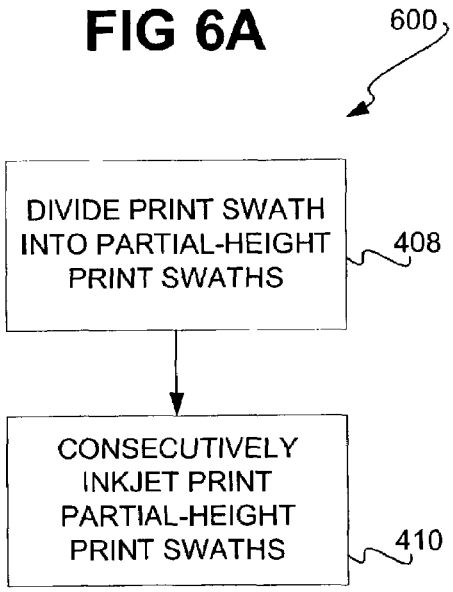
FIG. 6A is a flowchart for reducing the average power utilized while ink-jet printing a print swath of media by dividing the print swath into partial-height swaths, according to an embodiment of the invention.

FIG. 6A shows a method 600 for specifically performing 408 and 410 of the method 400 of FIG. 4, according to a particular embodiment of the invention. The media print swath is divided into a number of partial-height print swaths, as the average power reduction action (408). The print swath of media is then ink-jet printed by consecutively inkjet printing the partial-height print swaths during multiple passes over the media swath (410), as has been described in the previous section of the detailed description.

Figure 6B:
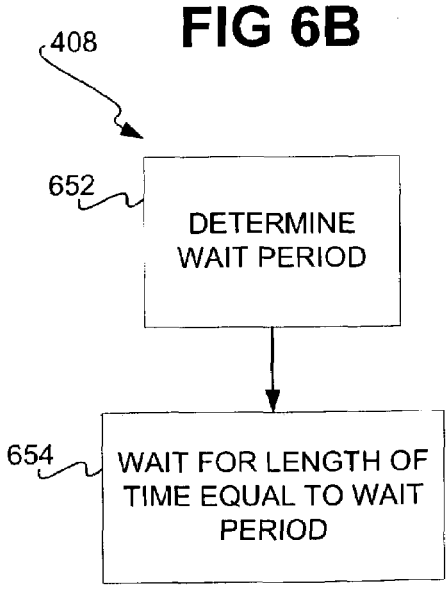
FIG. 6B is a flowchart for reducing the average power utilized while ink-jet printing a print swath of media by waiting for a period of time before or after ink-jet printing the swath, according to an embodiment of the invention.

FIG. 6B shows a method for specifically performing 408 of the method 400 of FIG. 4, according to another particular embodiment of the invention. A wait, or pause, period is determined that results in the average power utilization for ink-jet printing the print swath to decrease (652). For instance, the wait period may be set equal to the lowest multiple of the time period it takes to inkjet print the print swath that, when added to this time period, results in the average power utilization falling under the average power utilization threshold.

As an example, if the time period it takes to eject ink over the swath of media is t, then the wait period may be 3t. The average power utilized by the inkjet-printing mechanism in ejecting ink over the swath of media during the time period t may be 100% of a maximum value, such that dividing 100% by (3t+t) reduces the average power utilization over the time period (3t+t) to 25% of the maximum value. The average power utilization of 25% of the maximum value may thus be below an example average power utilization threshold of 30% of the maximum value. The wait period may alternatively be set in a different manner. Ultimately, a length of time is waited that is equal to the wait, or pause, period that has been determined (654).

Inkjet-Printing Device and Power Supply

Figure 7:
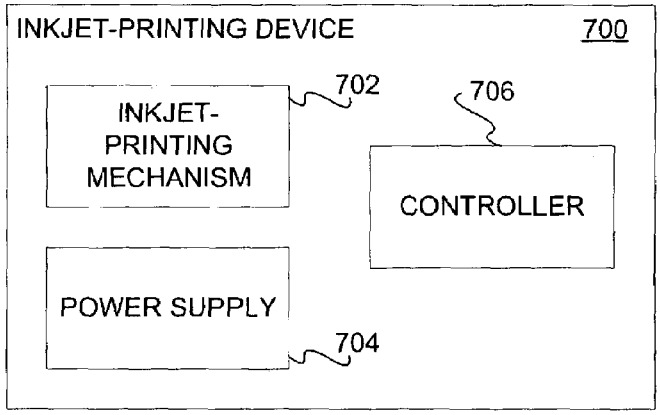
FIG. 7 is a block diagram of an inkjet-printing device, according to an embodiment of the invention.

FIG. 7 shows a block diagram of an inkjet-printing device 700, according to an embodiment of the invention. The inkjet-printing device 700 may be an ink-jet printer, or another type of device that includes inkjet-printing functionality. The inkjet-printing device 700 is shown in FIG. 7 as including an inkjet-printing mechanism 702, a power supply 704, and a controller 706. The inkjet-printing device 700 may include other components as well, in addition to and/or in lieu of those depicted in FIG. 7, as can be appreciated by those of ordinary skill within the art.

The inkjet-printing mechanism 702 ejects ink onto print swaths. The mechanism 702 may be an inkjet printhead, for instance, that has a number of inkjet nozzles, or jets. The power supply 704 is able to provide a maximum average amount of power to the inkjet-printing mechanism 702. In one embodiment, the maximum average amount of power that the power supply 704 is able to provide may be a percentage of a maximum, worst-case average amount of power utilized by the inkjet-printing mechanism 702 when printing a swath of media. The maximum average amount of power that the power supply 704 may be, for instance, equal to a normal-case average amount of power utilized by the mechanism 702, or equal to a most-cases average amount of power utilized by the mechanism 702. The power supply 704 may also provide power to other components of the inkjet-printing device 700.

The controller 706 may be hardware, software, or a combination of hardware and software. The controller 706 may include the firmware of the inkjet-printing device 700, and also may include a processing mechanism, such as a processor. The controller 706 performs an average power reduction action when the inkjet-printing mechanism 702 prints or is to print a print swath that causes the mechanism 702 to utilize more average power than the maximum average amount of power that the power supply 704 is able to provide. The power reduction action may include dividing the print swath into partial-height swaths, waiting for a period of time, and so on. The controller 706 may be the component of the inkjet-printing device 700 that performs, or causes other components to perform, the methods that have been described in the previous section of the detailed description.

Figure 8:
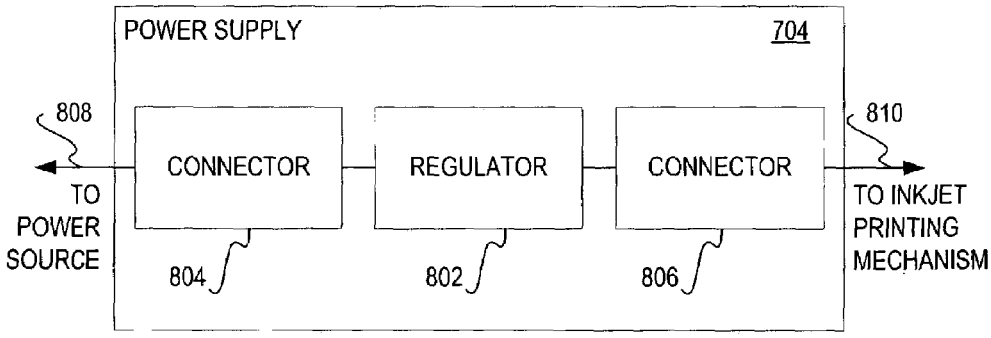
FIG. 8 is a block diagram of a power supply for an inkjet-printing device, according to an embodiment of the invention.

FIG. 8 shows a block diagram of the power supply 704 of FIG. 7 in more detail, according to an embodiment of the invention. The power supply 704 is depicted in FIG. 8 as including a regulator 802, and connectors 804 and 806. The power supply 704 may include other components as well, in addition to and/or in lieu of those depicted in FIG. 8, as can be appreciated by those of ordinary skill within the art. The connectors 804 and 806 are more generally referred to as connections.

The first connector 804 connects the power supply 704 to a source of power, as indicated by the arrow 808. The source of power may be a battery, such as a battery removably internal or external to the inkjet-printing device 700 of FIG. 7, a power outlet, such as a wall outlet, or another type of power source. The second connector 806 connects the power supply 704 to at least the inkjet-printing mechanism 702 of FIG. 7, as indicated by the arrow 810, and optionally to other components of the inkjet-printing device 700 as well.

The regulator 802 interfaces the power source to at least the inkjet-printing mechanism 702 of FIG. 7, via being operably connected to the connectors 804 and 806. The regulator 802 may convert the power provided by the power source to a form that is amenable to the inkjet-printing mechanism 702. For instance, the regulator 802 may convert high-voltage alternating current from a power outlet to low-voltage direct current usable by the inkjet-printing mechanism 702. In one embodiment, the regulator 802 may be a transformer. The regulator 802 may include a number of different electrical and other types of components as well.

CONCLUSION

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of embodiments of the present invention. Therefore, it is manifestly intended that this invention be limited only by the claims and equivalents thereof.

We claim:

1. A method comprising:

inkjet printing a particular print swath;

after inkjet printing the print swath, determining average power utilization for inkjet printing the print swath; and, in response to determining that the average power utilization exceeds a threshold corresponding to an average power utilized when inkjet printing a swath of media for a typical print job, performing an average power reduction action.

2. The method of claim 1, wherein determining that the average power utilization exceeds the threshold comprises determining that the average power utilization exceeds a maximum average power amount able to be provided by a power supply for inkjet printing a print swath.

3. The method of claim 1, wherein performing the average power reduction action comprises:

dividing the print swath into a plurality of partial-height print swaths; and, separately inkjet printing the plurality of partial-height print swaths.

4. A method comprising:

determining average power utilization for inkjet printing a particular print swath, comprising:

determining a number of ink drops ejected to inkjet print the print swath;

determining a length of time to inkjet print the print swath; and, determining the average power utilization based on the number of ink drops ejected and the length of time to inkjet print the print swath; and, in response to determining that the average power utilization exceeds a threshold corresponding to an average power utilized when inkjet printing a swath of media for a typical print job, performing an average power reduction action.

5. The method of claim 4, wherein determining the average power utilization is performed after inkjet printing the print swath.

6. A method comprising:

determining average power utilization for inkjet printing a particular print swath;

in response to determining that the average power utilization exceeds a threshold corresponding to an average power utilized when inkjet printing a swath of media for a typical print job, performing an average power reduction action, wherein the threshold corresponds to a predetermined percentage of an amount of average power utilized when inkjet printing a swath of media for a worst-case print job.

7. A method comprising:

determining average power utilization for inkjet printing a particular print swath;

in response to determining that the average power utilization exceeds a threshold corresponding to an average power utilized when inkjet printing a swath of media for a typical print job, performing an average power reduction action, comprising:

determining a pause period that results in the average power utilization for inkjet printing the print swath to decrease; and waiting for a length of time equal to the pause period to decrease the average power utilization.

8. The method of claim 7, further comprising inkjet printing the print swath after waiting for the length of time.

9. An inkjet-printing device comprising:

an inkjet-printing mechanism to eject ink onto print swaths;

a power supply able to provide a maximum average amount of power to the inkjet-printing mechanism for inkjet-printing a print swath; and, a controller to perform an average power reduction action when the inkjet-printing mechanism prints a print swath that causes the inkjet-printing mechanism to utilize more average power than the maximum average amount of power that the power supply is able to provide, wherein the controller is to perform the average power reduction action after the inkjet-printing mechanism prints the print swath.

10. The device of claim 9, wherein the maximum average amount of power that the power supply is able to provide to the inkjet-printing mechanism is equal to an amount of average power utilized when inkjet printing a swath of media for a typical print job.

11. The device of claim 9, wherein the maximum average amount of power that the power supply is able to provide to the inkjet-printing mechanism is equal to an amount of average power utilized when inkjet printing swaths of media for most print jobs.

12. The device of claim 9, wherein the average power reduction action comprises dividing the print swath into a plurality of partial-height print swaths and causing the inkjet-printing mechanism to separately print the plurality of partial-height print swaths.

13. The device of claim 9, wherein the inkjet-printing device is an inkjet printer.

14. An inkjet-printing device comprising:

an inkjet-printing mechanism to eject ink onto print swaths;

a power supply able to provide a maximum average amount of power to the inkjet-printing mechanism for inkjet-printing a print swath; and, a controller to perform an average power reduction action when the inkjet-printing mechanism prints a print swath that causes the inkjet-printing mechanism to utilize more average power than the maximum average amount of power that the power supply is able to provide, wherein the maximum average amount of power that the power supply is able to provide to the inkjet-printing mechanism is equal to a predetermined percentage of an amount of average power utilized when inkjet printing a swath of media for a worst-case print job.

15. The device of claim 14, wherein the controller is to perform the average power reduction action after the inkjet-printing mechanism prints the print swath.

16. An inkjet-printing device comprising:

an inkjet-printing mechanism to eject ink onto print swaths;

a power supply able to provide a maximum average amount of power to the inkjet-printing mechanism for inkjet-printing a print swath; and, a controller to perform an average power reduction action when the inkjet-printing mechanism prints a print swath that causes the inkjet-printing mechanism to utilize more average power than the maximum average amount of power that the power supply is able to provide, wherein the controller is to determine that printing the print swath by the inkjet-printing mechanism causes the inkjet-printing mechanism to utilize more average power than the maximum average amount of power that the power supply is able to provide by determining a number of ink drops that are ejected to inkjet print the print swath and a length of time needed to inkjet print the print swath.

17. An inkjet-printing device comprising:

an inkjet-printing mechanism to eject ink onto print swaths;

a power supply able to provide a maximum average amount of power to the inkjet-printing mechanism for inkjet-printing a print swath; and, a controller to perform an average power reduction action when the inkjet-printing mechanism prints a print swath that causes the inkjet-printing mechanism to utilize more average power than the maximum average amount of power that the power supply is able to provide, wherein the average power reduction action comprises determining a pause period that results in the average power utilized by the inkjet-printing mechanism to print the print swath to decrease, and causing the inkjet-printing mechanism to wait for a length of time equal to the pause period to decrease the average power utilized.

18. An inkjet-printing device comprising:

an inkjet-printing mechanism to eject ink onto print swaths;

a power supply able to provide a maximum average amount of power to the inkjet-printing mechanism; and, means for determining the inkjet-printing mechanism utilizes more average power when printing the print swath than the maximum average amount of power that the power supply is able to provide and, in response thereto, for causing the inkjet-printing mechanism to wait for a pause period that results in the average power utilized by the inkjet-printing mechanism to print the print swath to decrease.

19. The device of claim 18, wherein the maximum average amount of power that the power supply is able to provide to the inkjet-printing mechanism is equal to an amount of average power utilized when inkjet printing a swath of media for a typical print job.

20. The device of claim 18, wherein the maximum average amount of power that the power supply is able to provide to the inkjet-printing mechanism is equal to a predetermined percentage of an amount of average power utilized when inkjet printing a swath of media for a worst-case print job.

21. The device of claim 18, wherein the maximum average amount of power that the power supply is able to provide to the inkjet-printing mechanism is equal to an amount of average power utilized when inkjet printing swaths of media for most print jobs.

22. An inkjet-printing device comprising:

an inkjet-printing mechanism to eject ink onto print swaths;

a power supply able to provide a maximum average amount of power to the inkjet-printing mechanism; and, means for determining that the inkjet-printing mechanism utilizes more average power when printing the print swath than the maximum average amount of power and for dividing the print swath into separately inkjet-printed partial-height print swaths in response thereto.

23. The device of claim 22, wherein the maximum average amount of power is equal to an amount of average power utilized when inkjet printing a swath of media for a typical print job.

24. The device of claim 22, wherein the maximum average amount of power that the power supply is able to provide to the inkjet-printing mechanism is equal to a predetermined percentage of an amount of average power utilized when inkjet printing a swath of media for a worst-case print job.

25. The device of claim 22, wherein the maximum average amount of power that the power supply is able to provide to the inkjet-printing mechanism is equal to an amount of average power utilized when inkjet printing swaths of media for most print jobs.

26. A computer-readable medium having a computer program stored thereon to perform a method comprising:

determining average power utilization for inkjet printing a particular print swath; and, in response to determining that the average power utilization exceeds a threshold corresponding to an average power utilized when inkjet printing a swath of media for a typical print job, performing an average power reduction action selected from the group essentially consisting of:

a first action comprising:

determining a pause period that results in the average power utilization for inkjet printing the print swath to decrease; and, waiting for a length of time equal to the pause period to decrease the average power utilization; and, a second action comprising:

dividing the print swath into a plurality of partial-height print swaths; and, separately inkjet printing the plurality of partial-height print swaths, wherein determining the average power utilization for inkjet printing the print swath comprises:

determining a number of ink drops ejected to inkjet print the print swath;

determining a length of time to inkjet print the print swath; and, determining the average power utilization based on the number of ink drops ejected and the length of time to inkjet print the print swath.

27. The medium of claim 26, wherein determining that the average power utilization exceeds the threshold comprises determining that the average power utilization exceeds an amount of average power utilized when inkjet printing a swath of media for a typical print job.

28. The medium of claim 26, wherein determining that the average power utilization exceeds the threshold comprises determining that the average power utilization exceeds a predetermined percentage of an amount of average power utilized when inkjet printing a swath of media for a worst-case print job.

29. The medium of claim 26, wherein determining that the average power utilization exceeds the threshold comprises determining that the average power utilization exceeds an amount of average power utilized when inkjet printing swaths of media for most print jobs.

30. The medium of claim 26, wherein determining that the average power utilization exceeds the threshold comprises determining that the average power utilization exceeds a maximum average power amount able to be provided by a power supply.

* * * * *